US010612166B1

(12) United States Patent
Ball

(10) Patent No.: US 10,612,166 B1
(45) Date of Patent: Apr. 7, 2020

(54) FIRE RESISTANT FABRIC WITH STITCHBONDING

(71) Applicant: Waubridge Specialty Fabrics, LLC, Chester, VA (US)

(72) Inventor: Alan G. Ball, Jamestown, NC (US)

(73) Assignee: Waubridge Specialty Fabrics, LLC, Chester, VA (US)

( * ) Notice: Subject to any disclaimer, the term of this patent is extended or adjusted under 35 U.S.C. 154(b) by 56 days.

(21) Appl. No.: 15/961,991

(22) Filed: Apr. 25, 2018

Related U.S. Application Data

(60) Provisional application No. 62/500,733, filed on May 3, 2017.

(51) Int. Cl.

| | |
|---|---|
| ***D03D 15/12*** | (2006.01) |
| ***D04H 1/72*** | (2012.01) |
| ***D03D 1/00*** | (2006.01) |
| ***A62C 2/06*** | (2006.01) |
| ***A62B 17/00*** | (2006.01) |
| ***A41D 31/08*** | (2019.01) |

(52) U.S. Cl.
CPC ..... *D03D 15/12* (2013.01); *A41D 31/08* (2019.02); *A62B 17/003* (2013.01); *A62C 2/06* (2013.01); *D03D 1/0035* (2013.01); *D04H 1/72* (2013.01); *D10B 2321/101* (2013.01); *D10B 2331/021* (2013.01); *D10B 2401/04* (2013.01); *D10B 2501/00* (2013.01)

(58) Field of Classification Search
CPC ..... A62B 17/003; C08L 2203/12; C08L 2203/03; C08L 2205/16; C08L 33/20; D02G 3/047; D02G 3/443; D03D 15/12; D03D 1/0035; Y10S 428/921; A41D 31/08; Y10T 442/40; Y10T 442/60; Y10T 442/444; A62C 2/06; D04H 1/72; D04H 1/43; D04H 1/4342; D10B 2321/101; D10B 2331/021; B32B 2262/0246; B32B 2262/0261; B32B 2262/14; B32B 2437/3065; B32B 5/08
USPC ..... 2/69, 458, 81; 442/304, 302, 327, 199; 57/252; 428/920, 921, 311
See application file for complete search history.

(56) References Cited

U.S. PATENT DOCUMENTS

| | | | |
|---|---|---|---|
| 6,102,128 | A | 8/2000 | Bridgeman |
| 6,946,412 | B2 | 9/2005 | Campbell et al. |
| 7,065,950 | B2 | 6/2006 | Zhu et al. |
| 7,348,059 | B2 | 3/2008 | Zhu et al. |
| 8,069,642 | B2 | 12/2011 | Zhu |
| 8,069,643 | B2 | 12/2011 | Zhu |
| 8,448,309 | B2 | 5/2013 | Kim et al. |

(Continued)

*Primary Examiner* — Camie S Thompson
(74) *Attorney, Agent, or Firm* — John H. Thomas, P.C.

(57) ABSTRACT

A washable fire-resistant fabric and a method for making a washable fire-resistant fabric comprises a lightweight pliant non-woven batt blended from two or more types of fire-resistant organic fibers which are non-irritating to human skin. A method for stitch bonding a pliant batt of intertwined fire-resistant fibers to form a fabric which is durable and resistant to unraveling is also provided. The fabric has fire-resistant properties wherein the fabric prevents the ignition of articles made therefrom when exposed to high heat or flame sources and further insulates a wearer of the clothing from high heat or flame sources to prevent serious burns.

14 Claims, 3 Drawing Sheets

(56) References Cited

U.S. PATENT DOCUMENTS

| | | | | |
|---|---|---|---|---|
| 2007/0065685 | A1* | 3/2007 | Bridgeman | D04H 1/52 442/327 |
| 2011/0104466 | A1* | 5/2011 | Atkinson | D02G 3/443 428/219 |
| 2013/0042385 | A1* | 2/2013 | Hines | D02G 3/047 2/85 |
| 2014/0157832 | A1 | 6/2014 | Thompson et al. | |
| 2015/0110993 | A1* | 4/2015 | Rock | B32B 5/26 428/97 |
| 2015/0159304 | A1 | 6/2015 | Schmitt et al. | |
| 2015/0299905 | A1 | 10/2015 | Shimada et al. | |

* cited by examiner

FIRE RESISTANT FABRIC WITH STITCHBONDING

This application claims the benefit of U.S. Provisional Patent Application No. 62/500,733, filed May 3, 2017, which is incorporated by reference herein in its entirety.

The present invention relates to fire-resistant fabrics which may be used, for example, in the making of clothing. For example, heat and flame resistant fibers are used to produce fire-resistant clothing for firefighters.

BACKGROUND OF THE INVENTION

Firefighting clothing, such as fire turnout gear utilized by fire departments, generally comprises over-garments which are manufactured and specifically designed to protect a firefighter while fighting a fire. Firefighting apparel exhibiting excellent fire-resistance is expensive. The materials used in firefighting apparel include fibers from the aramid family, and even higher-technology, higher-cost fibers such as polyimide fibers and the like.

In another example, clothing, and in particular children's clothing such as pajamas, are often labeled as fire-retardant. However, clothing so labeled and the fabrics from which the clothing is made are not fire-resistant. The clothing and fabrics so labeled are generally made from either natural fibers such as cotton, or synthetic fibers such as rayon. These fibers and fabrics made therefrom may be flammable in nature. To label clothing made from these fibers as fire-resistant, manufacturers treat the fibers with chemical compounds in an attempt to alter the flammability characteristics. However, the chemical compounds used in such treatments generally do not alter the flammability of the fibers or fabrics, but rather operate to delay or lengthen the time between the exposure of the fabric to high heat and the point at which the fabric will ignite.

Therefore, there is an ongoing need for a fire-resistant fabric from which clothing can be made which will not ignite when subjected to a source of intense heat, and which is also soft and pliant so as to be non-irritating to human skin.

SUMMARY OF THE INVENTION

One aspect of the present invention is a fire-resistant fabric including a lightweight, pliant, non-woven batt blended from one or more fire-resistant fibers from the aramid family, modacrylic non-combustible fibers, and oxidized polycrylonitrile ("PAN") fiber. In certain embodiments, the fabric contains between 0% and 60% by weight of each of the fibers, in other embodiments, roughly equal amounts of a meta-aramid fiber, a para-aramid fiber and a modacrylic fiber, and in other embodiments roughly equal amounts of a PAN fiber, a para-aramid fiber and a modacrylic fiber.

Another aspect of the present invention is a method for making a fire-resistant fabric including the steps of combining the above fibers into a non-woven batt of intertwined fibers, stitch bonding the batt of intertwined non-woven fibers, and forming the stitch bonded batt into clothing or household articles. This method of stitch bonding a batt of intertwined non-woven fire-resistant fibers may use both chain stitches and tricot stitches to form a fire-resistant fabric which is washable, durable, and resistant to unraveling.

In one example, a fire-resistant fabric is formed of a plurality of fiber components, the fabric comprising 25 to 50 weight percent of para-aramid fibers, 10 to 50 weight percent of modacrylic fibers, zero to 50 weight percent of meta-aramid fibers, and zero to 50 weight percent of oxidized polyacrylonitrile (PAN) fibers, wherein the percentages are based on the relative weights of the foregoing fiber components. The fabric is formed of nonwoven fibers or woven fibers. In the example of nonwoven fibers, the nonwoven fibers form a nonwoven batt of intertwined fibers, and the batt is stitch bonded together to form the fabric. The fabric may comprise zero meta-aramid fibers. The fabric may comprise zero PAN fibers. The fabric may comprise 30 to 40 weight percent of the para-aramid fibers. The fabric may comprise 20 to 40 weight percent of the modacrylic fibers. The fabric may comprise 15 to 35 weight percent of the PAN fibers.

In another example, a fire-resistant garment including a fire-resistant fabric formed of a plurality of fiber components, the fabric comprises 25 to 50 weight percent of para-aramid fibers, 10 to 50 weight percent of modacrylic fibers, zero to 50 weight percent of meta-aramid fibers, and zero to 50 weight percent of oxidized polyacrylonitrile (PAN) fibers, wherein the percentages are based on the relative weights of the foregoing fiber components. The fabric may be formed of nonwoven fibers or woven fibers. In the example of nonwoven fibers, the nonwoven fibers form a nonwoven batt of intertwined fibers, and the batt is stitch bonded together to form the fabric. The fabric may comprise zero meta-aramid fibers. The fabric may comprise zero PAN fibers. The fabric may comprise 30 to 40 weight percent of the para-aramid fibers. The fabric may comprise 20 to 40 weight percent of the modacrylic fibers. The fabric may comprise 15 to 35 weight percent of the PAN fibers.

These and other features, advantages, and objects of the present invention will be further understood and appreciated by those skilled in the art by reference to the following specification, claims, and appended drawings.

DETAILED DESCRIPTION

Figure 2:
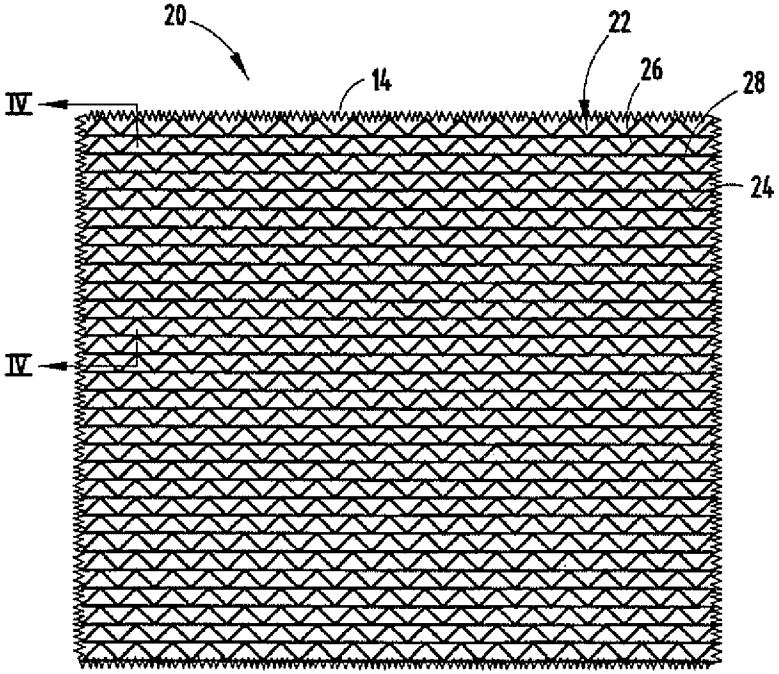
FIG. 2 is a top plan view of a section of fabric showing a plurality of proximate rows of "chain" and "tricot" stitches from the stitch bonding process.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

According to one or more examples, a soft, fire-resistant (FR) fabric is comprised of two or more types of organic fire-resistant fibers. While there are numerous inorganic fibers which are also fire-resistant or non-combustible, such fibers possess a general characteristic of being an irritant to human skin, therefore rendering the use of such fibers undesirable in a fabric which is intended for human contact including clothing and other household articles, such as blankets, mattress pads, furniture fabrics, glove liners, aprons, pot holders, etc. Since one of the uses of the fabric according to the present invention is for clothing such as children's sleepwear, the fabric should be economical to produce, thereby making the clothing affordable for private individuals and, at the same time, washable and sufficiently lightweight and soft to facilitate the wearing thereof by young children. Therefore, in selecting the appropriate fibers for use in the fire-resistant fabric according to the present invention, additional characteristics other than fire-resistance are preferably taken into consideration.

As used herein, fire-retardant means the ability of a material to resist burning or supporting combustion, although it will eventually char to ashes. Fire-resistant means the material will not support flame.

While many fibers possess the requisite fire-resistant characteristics desired of fibers which are used in clothing, bedding, and other applications contacting human skin, these fibers may also have inherent characteristics which lessen their desirability for such use. For example, some of the organic fibers which are fire-resistant also display characteristics of extremely high strength, and thus are difficult to cut and cause excessive wear on shears and on the looms used to weave the fire-resistant fabric. Other fibers, while displaying fire-resistant characteristics, may tend to either shrink or melt at elevated temperatures. These characteristics decrease the desirability of the fiber for the desired uses. Also, candidate fibers of the fire-resistant category are often times relatively expensive when compared to other fibers. Thus, the selection of one or more fibers becomes dependent upon a number of characteristics in order to produce a fabric which is economical, lightweight, and safe for repeated everyday human use, yet will serve in a fire emergency situation to protect and shield an individual from serious burns. Typically, the organic fire-resistant fibers suitable for use in the preferred embodiment are members of the aramid or polyimide families.

Oxidized polyacrylonitrile, is commonly known as PAN fiber. In addition to being a carbon fiber precursor, Oxidized PAN Fiber is also used to produce inherently flame resistant (FR) fabrics. Commonly, when it is used in FR fabrics for protective apparel, it is referred to as OPF (Oxidized Polyacrylonitrile Fiber) and is a high-performance and cost-effective flame and heat resistance solution. OPF can be considered one of the most FR fabrics commercially produced since it has an LOI (Limiting Oxygen Index) in the range of 45%-55% which is one of the highest LOI ranges available as compared with other common FR fabrics which have lower LOI values (e.g. Nomex @ 28%-30%, Kevlar @ 28%-30%, Modacyrlic @ 32%-34%, PBI @ 41%, and FR-Viscose @ 28%); and OPF also demonstrates the lowest toxic gas generation upon burning as compared with other common fabrics (e.g. Nomex, FR Polyester, and Cotton).

The polyimide family of fibers is probably the most widely known of the organic fibers for its strength and heat resistant characteristics. In particular, the aromatic polyimide family, also known as aramids, has a combination of high strength, toughness, and thermal stability. The aramid fibers are manufactured from a long-chain synthetic polyimide in which at least about 85% of the imide (—CO—NH—) linkages are attached directly between two aromatic rings. The more well-known aramids display high fire-resistant characteristics in that the fibers do not melt, but rather decompose at rather high temperatures of approximately 450.degree. C., thus making the aramid fibers suitable for use in applications requiring fire-resistancy. One form of such an aramid fiber is marketed under the name KEVLAR®, available from DuPont Chemical. Other fire-resistant aramid fibers are marketed under the name NOMEX®, available from DuPont Chemical; P84®, available from Degussa Inspec Fibres GmbH, Lenzing, Austria; and TWARON®, available from Teijin Twaron USA, Inc., Conyers, Ga.

Acrylic fibers are well-known in the synthetic fiber and fabric industries, as are modified acrylic fibers (modacrylic). Non-combustible modacrylic fibers are made from resins that are copolymers of acrylonitrile and other materials, such as vinyl chloride, vinylidene chloride, or vinyl bromide. Modacrylic fibers are modified to exhibit heat resistance. Such modacrylic fibers exhibit higher melting temperatures, e.g., 100-125 degrees C. or higher as compared to 90-100 degrees C. for acrylics not so modified, and higher deflection temperatures under load, e.g., 190-221 degrees F. at 264 p.s.i. as compared to 160-190 degrees F. for acrylics not so modified. However, modacrylic fibers are relatively inexpensive, and in combination with other fibers improve the affordability in the manufacturing of a fire-resistant fabric, which is comfortable and non-irritating when it comes into contact with human skin. Suitable non-combustible modacrylic fibers include PROTEX® and KANECARON®, both available from Mitsui Lifestyle (U.S.A.), Inc. of New York, N.Y.

While any one of the above fibers in and of itself is a potential candidate to create a fire-resistant fabric (according to one embodiment), a blend of fibers from the above group will contribute desirable characteristics and enhance the affordability while maintaining its fire-resistant performance when combined into a fabric.

It has been determined that relative ranges of specific fibers are very useful when producing a fire resistant fabric material. In basic blends, there will be varying amounts of three and all four of the following four component fibers: Para-aramid (p-aramid) fibers, Meta-aramid (m-aramid) fibers, modacrylic fibers and PAN fibers. Both p-aramid fibers and modacrylic fibers are used in each blend. M-aramid and/or PAN fibers may optionally be added to this initial combination of fibers. Specifically, a p-aramid fiber can be used to form from about 25 to 50% of the total fiber blend, or alternatively about 30 to 40%. In another example, the p-aramid fiber can be used to form at least about 25% of the total fiber blend, or alternatively at least about 30%, or still further alternatively at least about 35%. An m-aramid fiber can be used to form from about zero to 50% of the total fiber blend, or alternatively about 10 to 40%, or still further about 30 to 40%. The modacrylic fiber may be used to form from about 10 to 50% of the total fiber blend, or alternatively about 20 to 40%, or still further alternatively about 25 to 35%. The PAN fibers can be used to form about zero to 50% of the total fiber blend, or alternatively about 15 to 35%, or still further alternatively about 20 to 30%.

Figure 1:
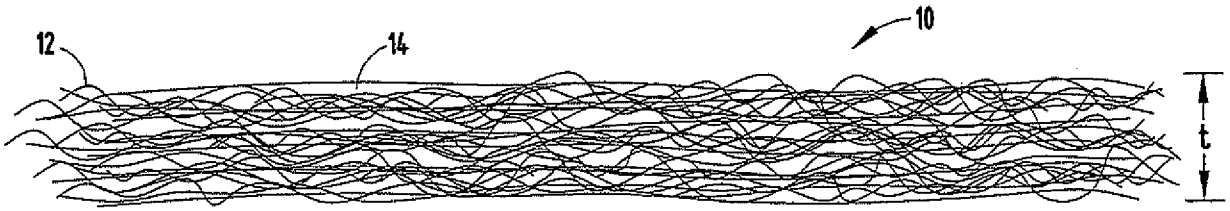
FIG. 1 is a side view of a section of fabric according to the present invention prior to stitch bonding, showing the non-woven intertwining of the fibers.

Referring now to FIG. 1, a non-woven batt of fabric is shown generally at 10 wherein a plurality of fibers 12 are combined in a non-woven fashion to form a substantially flat section of material 14 which is of a general uniform thickness. Fibers 12 are generally combined in such a way so that each of the different types of fibers is substantially uniformly dispersed throughout material 14. Fibers 12 are combined in a non-woven manner by a process known in the industry as "needling." In the needling process, fibers 12 are combined and uniformly distributed in their relative desired proportions and delivered to the needling apparatus whereby a plurality of needle-like projections engage and intertwine fibers 12 in such a manner as to substantially interlock the fibers to form material 14 in its desired thickness t. The needling process creates material batts that are more compressed and have less loft than the raw needled material 14. In one preferred embodiment, needled material 14 is from about ⅛ to about 7⁄16 inch thick and weighs approximately four to about ten ounces per square yard. In another preferred embodiment, needled material 14 is approximately 3⁄16 inch thick and weighs approximately six to seven ounces per square yard.

Because the fibers 12 are not woven but are merely intertwined, a fabric produced by this process does not lend itself to repeated washings, since the washing action tends to disengage some of the intertwined fibers whereby the fibers become dislodged one from the other. As such, the material tends to deform, pull, and become generally unsightly, thereby rendering it less suitable for use. This is avoided in a preferred embodiment by stitch bonding the non-woven materials.

Figure 4:
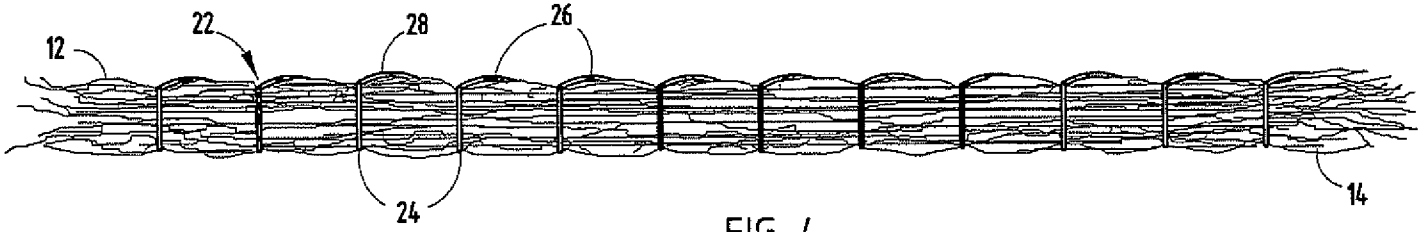
FIG. 4 is a cross-sectional view taken along the lines IV-IV of FIG. 2 showing the stitch bonding retaining the non-woven fibers in place.
Figure 3:
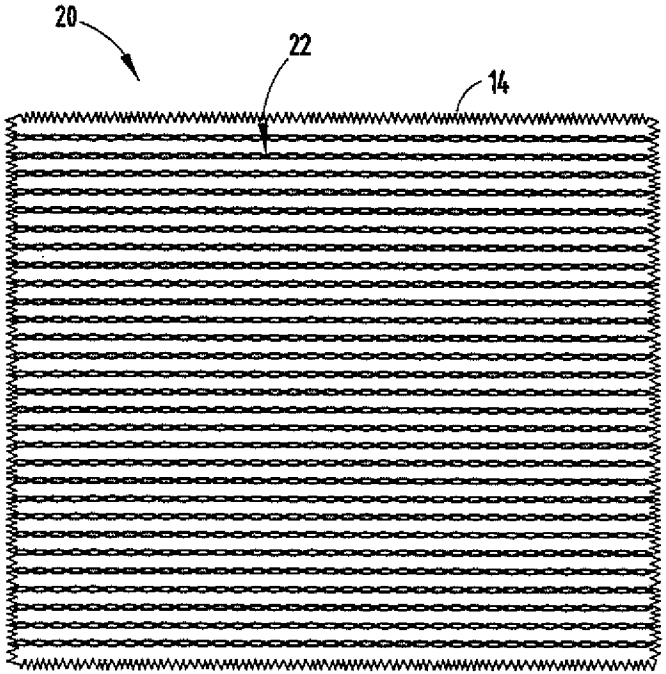
FIG. 3 is a bottom plan view of a section of fabric showing a plurality of proximate rows of stitches from the stitch bonding process.

Referring now to FIGS. 2-4, a finished fabric 20 includes a needled section of non-woven material 14 further comprising a plurality of parallel rows 22 of stitching. This process is known in the industry as stitch bonding and is used primarily to bond together a plurality of layers of material, wherein all or part of the layers are woven. The parallel rows 22 include "chain" stitches 24 and "tricot" stitches 26. The tricot stitches 26 exhibit a zigzag or herringbone pattern in which the stitching threads on one surface of material 14. Although the rows of chain stitches 24 and of tricot stitches 26 are proximately associated, in a preferred embodiment, the chain stitches 24 and tricot stitches 26 are physically connected. In another preferred embodiment, stitching rows comprise parallel rows 22 of chain stitches 24 and tricot stitches 26, wherein the rows 22 are spaced at approximately 1⁄7 inch intervals. While the completed fabric 20 after stitch bonding is more compressed and has less loft than the raw needled material 14, the stitch bonded finished fabric 20 now becomes washable on a repeated basis without the deterioration of the interlocked relationship of fibers 12.

The fabric 20, which has been stitch bonded using both chain and tricot stitches, has a smoother surface than prior fire-resistant fabrics. In addition, the combination of chain and tricot stitching pattern yields a fire-resistant fabric which is sturdier, more durable, and more aesthetically pleasing. Also, the combined chain and tricot stitching pattern enhances the interlocked relationship, making the fire-resistant fabric less likely to unravel if cut or pulled.

FIG. 4 illustrates (in cross section) a plurality of rows 22 of stitching wherein the thread 28 of the stitching captures and traps the intertwined fibers 12 to prevent them from dislodging. In one embodiment, thread 28 is a flat or textured polyester or rayon thread. Although these threads are not fire-resistant and may melt or burn when subjected to high temperatures, when it does melt or burn, it tends to make the fabric 14 more "fluffy," or have a slightly higher loft. It is presently believed that the increase in loft actually increases the fire-resistance by providing additional air spaces within the fabric material 14.

Instead of utilizing a polyester thread, a fire-retardant or fire-resistant yarn may also be used to stitch bond the non-woven pliant section of intertwined fibers. This can either be, for example, polyester thread which has been chemically-treated or yarn made from fire-resistant fibers, such as melamine or aramid fibers. Chemically-treated polyester fire-resistant yarn will disintegrate, but not as quickly as a yarn that has not been chemically-treated. When subjected to high heat, yarn made from fire-resistant fibers would char, but not sustain flame. In a preferred embodiment, the fabric 14 is stitch bonded using a fire-resistant yarn made from fire-resistant fibers and would resist melting, thereby retaining the stitch bonding and durability of the fabric.

The stitch bonding as disclosed herein can be used with any fire-retardant or fire-resistant fabric, including a fabric using the composition of the preferred embodiment and the composition disclosed in U.S. Pat. No. 6,102,128, which is hereby incorporated by reference.

Figure 5:
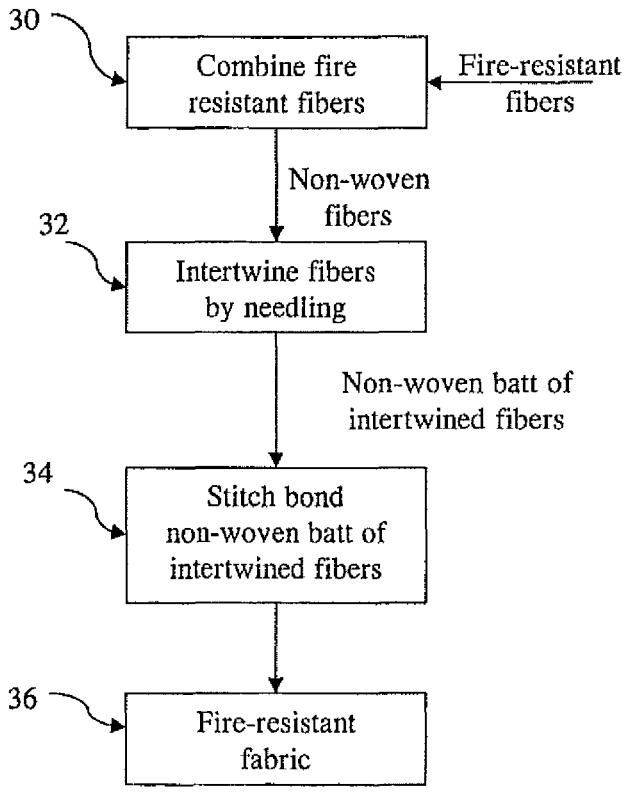
FIG. 5 is a flow chart illustrating a method for making a fabric according to one embodiment of the present invention.

FIG. 5 illustrates a method for creating a fire-resistant fabric according to the present invention and includes combining fire-resistant fibers 30 to form non-woven fibers. In one preferred embodiment, approximately equal portions of meta-aramid and para-aramid fire-resistant organic fibers and modacrylic non-combustible organic fibers are combined. Next, the combined fibers are needled 32 into a non-woven batt of intertwined fibers. The batt of intertwined non-woven fibers are stitch bonded 34 as discussed above to form a fire-resistant fabric 36. The fire-resistant fabric 36 may then be optionally packaged as bolts of fabric to be cut and sewn into an article of clothing or blanket, for example.

The step of combining fire-resistant fibers 30 generally involves measuring out a predetermined amount of fire-resistant fibers. The fibers are combined and uniformly distributed in their relative desired proportions using wire rollers to form a section of non-woven fibers. The section of non-woven fibers is flattened out using a series of rollers having small needles.

Next, the non-woven fibers are sent to needling 32 where the non-woven fibers are further entangled. As discussed above, the needling apparatus includes a plurality of needle-like projections which engage and intertwine fibers such that the fibers are substantially interlocked to form a material in a desired thickness. After needling, material sections are more compressed and have less loft than the raw needled material, which enhances the thermal insulative properties of the produced material.

The inventive fabrics, which are produced according to the preferred embodiments, and the methods of creating a fabric of the present invention, are easily produced because of their ability to be easily manufactured. This includes the ease with which the fibers may be handled and/or processed as well as the lower wear characteristics of the material on the machinery itself. Further, by producing a fire-resistant fabric which is dyeable and/or printable, as well as comfortable and non-irritating when it comes into contact with human skin, the commercial applications are greatly increased. Additionally, since the fabric is non-woven, the complicated manufacturing steps related to the weaving process are removed and replaced with a less complicated and lower cost fabrication step of stitch bonding, thereby rendering the non-woven fabric more durable and washable. The fabric so produced may be further manufactured into garments or other useful items which may come into repeated or prolonged contact with human skin without causing discomfort, and which require periodic washing. For example (but not limited to): fire-resistant clothing such as children's pajamas; firefighting clothing, such as turnout gear; blankets; sleeping bags; glove liners, aprons, pot holders, or any other product wherein fire-resistancy and non-irritating contact with human skin is desired.

Of course, the fabric of the present invention may also be used in products and situations wherein non-irritation of human skin is not a requirement, such as curtains, rugs, upholstery fabric and the like.

Examples

Some examples of the foregoing fire resistant fiber blends were compared with a current, commercially available blend of fibers sold under the brand name of Kovenex (25% P-aramid/35% melamine/40% modacrylic). Example blend A below is this commercially-available product. Each of the example fabrics was stitch-bonded together in the same way as the Kovanex products, so the only differences between the examples is the noted fiber blends. Three different criteria are believed to be important characteristics of the product which is designed to perform, protect and endure: thermal protective performance (TPP), tear strength and cut protection.

1. The Thermal Protection Performance (TPP) test was developed by DuPont in the 1970s. It sets realistic conditions of an exposure of a fabric to combined radiant and convective heat. A fabric sample is subjected to circumstances typical for fires: a constant combination of 50% radiant heat and 50% convective heat, at a constant heat flux of 84 kW/m$^2$ (approximately 2 cal/cm$^2$/sec.). The test then measures the time that elapses and the amount of heat energy per surface area (TPP value) at which the temperature and energy transferred to the back of the fabric reaches a level which would cause a second-degree burn to the wearer of an item of Personal Protective Equipment (PPE). The TPP test has been adopted by ISO as a test method standard (ISO 17492) with a heat flux exposure of 80 kW/m$^2$.

The NFPA 1971 standard (Standard on Protective Ensembles for Structural Fire Fighting and Proximity Fire Fighting) requires the ISO 17492 test to be carried out at a modified, increased heat flux exposure of 84 kW/m$^2$.

The below tests were conducted internally by applicant and also at two external test labs according to the NFPA 1971 standard. Tests were conducted on existing (Melamine containing) blends and the new blends containing M-aramid and/or PAN fibers. The following results are an average of the external test data:

In all tests, fabric blends were as follows:

A) 25% P-Aramid/35% Melamine/40% Modacrylic (prior art)

B) 25% P-Aramid/35% M-Aramid/40% Modacrylic

C) 25% P-Aramid/25% M-Aramid/20% PAN/30% Modacrylic

D) 30% P-Aramid/30% PAN/40% Modacrylic

| | Area Weight (oz./sq.yd.) | | | | | | | | | |
|---|---|---|---|---|---|---|---|---|---|---|
| | 5.5 | | | | 8.5 | | | | 11.5 | |
| Fabric Blend | A | B | C | D | A | B | C | D | A | B |
| TPP Value (Cal/cm$^2$) | 8.75 | 9.1 | 10.81 | 10.07 | 12.35 | 13.47 | 13.83 | 12.89 | 17.59 | 18.98 |
| % Improvement v. Blend A | | 4.8% | 23.5% | 15.1% | | 9.1% | 12.0% | 4.4% | | 7.9% |

In all instances, the new inventive blends B, C and D all recorded improved performance versus blend A.

2. Tear strength is measured according to ASTM D5733. ASTM D5733 covers the measurement of the tearing strength of nonwoven fabrics by the trapezoid procedure using a constant-rate-of-extension (CRE) tensile testing machine. ASTM D5733 is used in the trade for acceptance testing of commercial shipments of nonwoven fabrics. Trapezoid tear strength as measured in this test method is the maximum tearing force required to continue or propagate a tear started previously in the specimen. The reported value is not directly related to the force required to initiate or start a tear.

ASTM D5733 tests were conducted at an external lab. The following results were obtained:

| | Area Weight (oz./sq.yd.) | | | | | | | | | |
|---|---|---|---|---|---|---|---|---|---|---|
| | 5.5 | | | | 8.5 | | | | 11.5 | |
| Fabric Blend | A | B | C | D | A | B | C | D | A | B |
| Tear strength (lb. force) avg. | 28.3 | 42.4 | | | 42.75 | 61.3 | 56.85 | 46.5 | 68.4 | 93.15 |
| % Improvement v. Blend A | | 49.8% | | | | 43.4% | 33.0% | 8.8% | | 36.2% |

As with the TPP tests, all instances of new blends B, C and D recorded improved performance versus blend A.

3. Finally, the fabrics were assessed with a cut test using standard ASTM F2992. This is the Standard Test Method for Measuring Cut Resistance of Materials Used in Protective Clothing with Tomodynamometer (TDM-100) Test Equipment. This test method assesses the cut resistance of a material when exposed to a cutting edge under specified loads. Data obtained from this test method can be used to compare the cut resistance of different materials. Results are measured in inch-pound units. The method is used in assessing cut level protection under ANSI 105-2016. ANSI/ISEA 105-2016 addresses the classification and testing of hand protection for specific performance properties related to mechanical protection (cut-resistance, puncture resistance and abrasion resistance), chemical protection (permeation resistance, degradation) and other performance characteristics such as ignition resistance and vibration reductions.

ASTM F2992 tests were conducted at an external lab. The following results were obtained:

| | Area Weight (oz./sq.yd.) | | | | | | | | | |
|---|---|---|---|---|---|---|---|---|---|---|
| | 5.5 | | | | 8.5 | | | | 11.5 | |
| Fabric Blend | A | B | C | D | A | B | C | D | A | B |
| Inch-pound units | 444 | 525 | | | 399 | 472 | 502 | 540 | 613 | 635 |
| % Improvement v. Blend A | | 18.2% | | | | 18.3% | 25.8% | 35.3% | | 3.6% |

Once again the new blends B, C and D showed improved performance versus blend A.

As is evident from the foregoing test results, the use of p-aramid fibers to form at least 25%, and preferably at least 30% of the total fiber blend results in good functional performance of fire resistance.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A fire-resistant fabric formed of a plurality of fiber components, the fabric comprising:

25 to 50 weight percent of para-aramid fibers, 10 to 50 weight percent of modacrylic fibers, zero to 50 weight percent of meta-aramid fibers, and zero to 50 weight percent of oxidized polyacrylonitrile (PAN) fibers, wherein the percentages are based on the relative weights of the foregoing fiber components; and wherein the fabric is formed of nonwoven fibers, and the nonwoven fibers form a nonwoven batt of intertwined fibers, and the batt is stitch bonded together to form the fabric.

2. A fire-resistant fabric as described in claim 1, wherein the fabric is formed of woven fibers.

3. A fire-resistant fabric as described in claim 1, wherein the fabric comprises zero meta-aramid fibers.

4. A fire-resistant fabric as described in claim 1, wherein the fabric comprises zero PAN fibers.

5. A fire-resistant fabric as described in claim 1, wherein the fabric comprises 30 to 40 weight percent of the para-aramid fibers.

6. A fire-resistant fabric as described in claim 1, wherein the fabric comprises 20 to 40 weight percent of the modacrylic fibers.

7. A fire-resistant fabric as described in claim 1, wherein the fabric comprises 15 to 35 weight percent of the PAN fibers.

8. A fire-resistant garment including a fire-resistant fabric formed of a plurality of fiber components, the fabric comprising:

25 to 50 weight percent of para-aramid fibers, 10 to 50 weight percent of modacrylic fibers, zero to 50 weight percent of meta-aramid fibers, and zero to 50 weight percent of oxidized polyacrylonitrile (PAN) fibers, wherein the percentages are based on the relative weights of the foregoing fiber components; and wherein the fabric is formed of nonwoven fibers, and the nonwoven fibers form a nonwoven batt of intertwined fibers, and the batt is stitch bonded together to form the fabric.

9. A fire-resistant garment as described in claim 8, wherein the fabric is formed of woven fibers.

10. A fire-resistant garment as described in claim 8, wherein the fabric comprises zero meta-aramid fibers.

11. A fire-resistant garment as described in claim 8, wherein the fabric comprises zero PAN fibers.

12. A fire-resistant garment as described in claim 8, wherein the fabric comprises 30 to 40 weight percent of the para-aramid fibers.

13. A fire-resistant garment as described in claim 8, wherein the fabric comprises 20 to 40 weight percent of the modacrylic fibers.

14. A fire-resistant garment as described in claim 8, wherein the fabric comprises 15 to 35 weight percent of the PAN fibers.

* * * * *